US005566989A

United States Patent [19]

Boing et al.

[11] Patent Number: 5,566,989

[45] Date of Patent: Oct. 22, 1996

[54] SOLIDS PIPELINE HAVING MULTIPLE ROTARY CONNECTORS

[75] Inventors: Eberhard Boing, Hagen; Rainer Moratschke, Dortmund, both of Germany

[73] Assignee: Vacmetal Gesellschaft fur Vakuum-Metallurgie mbH, Dortmund, Germany

[21] Appl. No.: 443,406

[22] Filed: May 17, 1995

[30] Foreign Application Priority Data

May 24, 1994 [DE] Germany ..... 44 18 145.0

[51] Int. Cl.[6] ..... F16L 27/00

[52] U.S. Cl. ..... 285/163; 285/184; 285/181; 285/168

[58] Field of Search ..... 285/163, 184, 285/168, 181

[56] References Cited

U.S. PATENT DOCUMENTS

| | | | |
|---|---|---|---|
| 1,140,508 | 5/1915 | Forth | 285/168 |
| 1,859,449 | 1/1932 | MacKenzie | 285/168 |
| 2,450,195 | 9/1948 | Grantham | 285/168 |
| 2,879,083 | 3/1959 | Corsette | 285/168 |
| 3,076,667 | 2/1963 | Klinger | 285/168 |
| 4,295,667 | 10/1981 | Zahs et al. | 281/18 |
| 4,909,544 | 3/1990 | Noe | 285/184 |

*Primary Examiner*—Eric K. Nicholson

*Attorney, Agent, or Firm*—Bell, Seltzer, Park & Gilbson, P.A.

[57] ABSTRACT

A pipeline for introduction of solids into a treatment vessel consists of a plurality of pipe elements made up of two or three pipe sections having their respective axes running at an obtuse angle to each another, with a rotary connection in the vertical plane between the pipe elements. One end of a pipe element extends into the rotary connection and the adjoining pipe element, which is here widened out to form a funnel.

6 Claims, 3 Drawing Sheets

SOLIDS PIPELINE HAVING MULTIPLE ROTARY CONNECTORS

FIELD OF THE INVENTION

The invention relates to a pipeline for introduction of solids or bulk material into a treatment vessel.

BACKGROUND OF THE INVENTION AND PRIOR ART

Such pipelines are used, for example, in a secondary metallurgical treatment of metal melts to introduce alloying and addition materials into a treatment vessel. Difficulties arise, in particular, when the treatment vessel is closed by a removable cover and/or has to be moved vertically. Both of these cases not only require a corresponding free space above the vessel but also prevent addition devices such as storage containers, locks for the introduction of solids under reduced pressure and metering devices from being located on the vessel or on the cover. This would in fact lead not only to considerably more space being needed, but especially to a quite considerable increase in weight, which would require correspondingly designed lifting or transport devices.

These problems are encountered, in particular, in the vacuum treatment of metal melts; thus for example in the RH process a vacuum vessel fitted with two suction pipes has to be raised before the treatment and then lowered over a ladle containing the melt to be treated until its two suction pipes dip into the melt in the ladle. The vacuum-lift or DH process requires a similar positioning of the vacuum vessel provided with a dipping pipe, which in addition is constantly raised and lowered during the vacuum treatment. Finally, in stand degassing a ladle containing the melt is introduced from a above into a vacuum vessel provided with a removable cover.

In all these cases it is necessary to keep the volume and the weight of the parts of the plant which need to be moved as small as possible, the more so as, with advances in secondary metallurgy and the increasing volume of the melts to be treated, the amounts of material to be added become greater and greater. This has led to the addition devices such as bunkers, locks and metering devices being fixed in place independently of the treatment vessel concerned usually at a higher level-and connected to the treatment vessel by way of pipelines.

In order to follow the movements of the treatment vessel and/or of a cover or to enable the space above the treatment vessel to be cleared it is known to use pipelines made up of lengths of pipe connected together telescopically. Such pipelines are able to take up the necessary movements of the vessel and/or of the cover, but they suffer from the disadvantage that as solids are introduced during the vacuum treatment air penetrates from the surroundings into the telescopic pipeline and consequently into the vacuum vessel, since it is impracticable to fit the individual lengths of pipe with seals which are a match for the reduced pressures of less than one mbar which are nowadays usual in intensive decarburisation. The reason for this is that the operating conditions in the secondary metallurgical treatment of metal melts are extraordinarily severe and the seals are not only exposed in part to considerable temperature stress but are also subjected to the abrasive wear caused by the more or less hard addition materials such as ferromanganese, ferrosilicon, ferrochromium, carbon, aluminum and limestone with a particle size of up to about 50 mm. To this is added the risk of formation of deposits of solids in the region where the walls of the lengths of pipe slide on one another.

The risk of deposits being formed also exists in the case of pipelines made in other ways, for example with elbows, particularly when sections of the pipeline are only slightly inclined to the horizontal and/or when the speed of transport of the solids is small.

OBJECT OF THE INVENTION

It is therefore an object of the invention to provide a pipeline which allows low-wear introduction of solids without the risk Of deposit formation, is sufficiently gastight for a reduced pressure treatment and at the same time has a sufficient amount of mobility to allow for movements of the vessel and/or the cover. In addition the pipeline should also be capable of being brought into a standby position which keeps the space immediately above the treatment vessel Clear.

SUMMARY OF THE INVENTION

To this end, the invention provides a pipeline with a plurality of pipe elements made up of pipe sections whose respective axes run at an obtuse angle to each another. These pipe elements are connected together through vertically disposed rotary connections, for example a ball bearing pressure connection, and thus form as a whole a quasi-S-shaped pipeline which, by pivoting the pipe elements about at least one of the horizontal axes of the rotary connections, can be shortened or pivoted aside, for example like an articulated lever. The invention thus provides an intrinsically movable pipeline with very slim bends.

The pipe elements may consist of three sections of which the respective axes correspond to the three short sides of a trapezium, that is to say, approximate to a pipe bend. In order to protect the rotary connections or to shield them from the material being conveyed, for example one end of a pipe element may extend into the adjoining rotary connection, preferably into the region of the adjoining pipe element. The end of the pipe element concerned may be widened in the form of a funnel in order to facilitate reliable and gentle passage of the material being conveyed from one,pipe element into the other.

The pipeline in accordance with the invention makes possible a flow of conveyed material which follows an approximately snake-like path, and thus deviates relatively little from the vertical and therefore keeps the risk arising from wear and deposition small. This is, for example, the case when the common axis of the adjoining pipe sections of two pipe elements in each case runs at an angle of about 30° to the vertical when the pipeline is in the stretched condition.

BRIEF DESCRIPTION OF THE DRAWINGS

The invention will now be described in more detail, by way of example, with reference to an embodiment shown in the drawings, in which.

DETAILED DESCRIPTION OF A PREFERRED EMBODIMENT OF THE DRAWINGS

Figure 1:
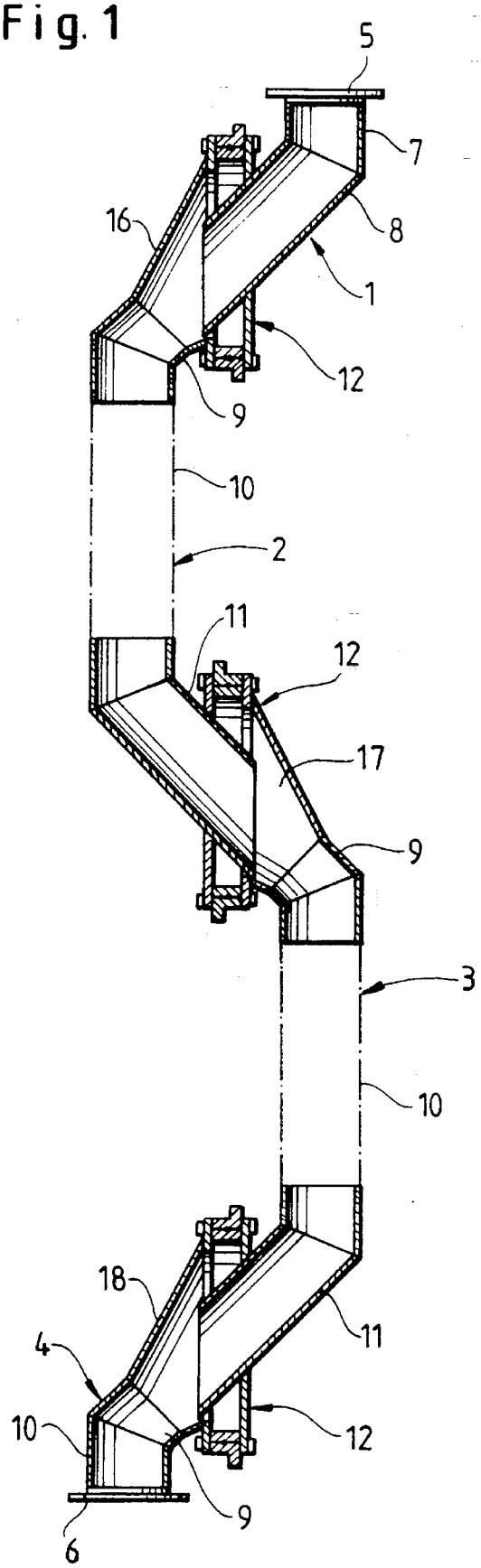
FIG. 1 shows a multipart pipeline in the stretched position.

The pipeline extends between a storage container (not shown), for example for alloying agent, and a treatment vessel (likewise not shown), for example for a vacuum treatment; it consists of several pipe elements 1 to 4. The pipe elements 1 and 4 are formed as connecting pieces and have flanges 5, 6 respectively for connection to the counterflange of a storage container (above) and a vacuum vessel (below).

The pipe elements each consist of several, in the present case two or three, pipe sections 7, 8 and 9, 10, 11. These pipe sections are connected together, for example by welding, so that their respective axes run at an obtuse angle to each another and the pipeline follows a roughly zig-zag line in the stretched state (FIG. 1), or runs roughly snake-like.

The pipe elements are connected together by rotary connections 12, between the halves 13, 14 of which a ball bearing 15 is arranged. In order to shield the rotary connections from the material being conveyed, in each case one pipe section 8, 11 extends through the respective rotary connection 12 into a funnel-shaped enlargement 16, 17, 18 of the adjoining pipe section 9 or pipe element 2, 3, 4. The funnel wall can run at an angle of about 45° to the diameter of the rotary connection. In this way it is ensured that in each angular position of the pipe elements on each side of a rotary connection one end of a pipe element opens inside the adjoining one and the rotary connection, and therefore the rotary connection cannot come into connection with the material being conveyed.

In the stretched state shown in FIG. 1 the length of the pipeline substantially corresponds to the distance between the storage container and the vacuum vessel; it can be shortened simply by pivoting at least one of the pipe elements about one of the horizontal axes of rotation of its two rotary connections. This results indirectly from the movement of the Vacuum vessel or of a cover, although the pipeline could also be provided with a lifting mechanism of its own.

Figure 2:
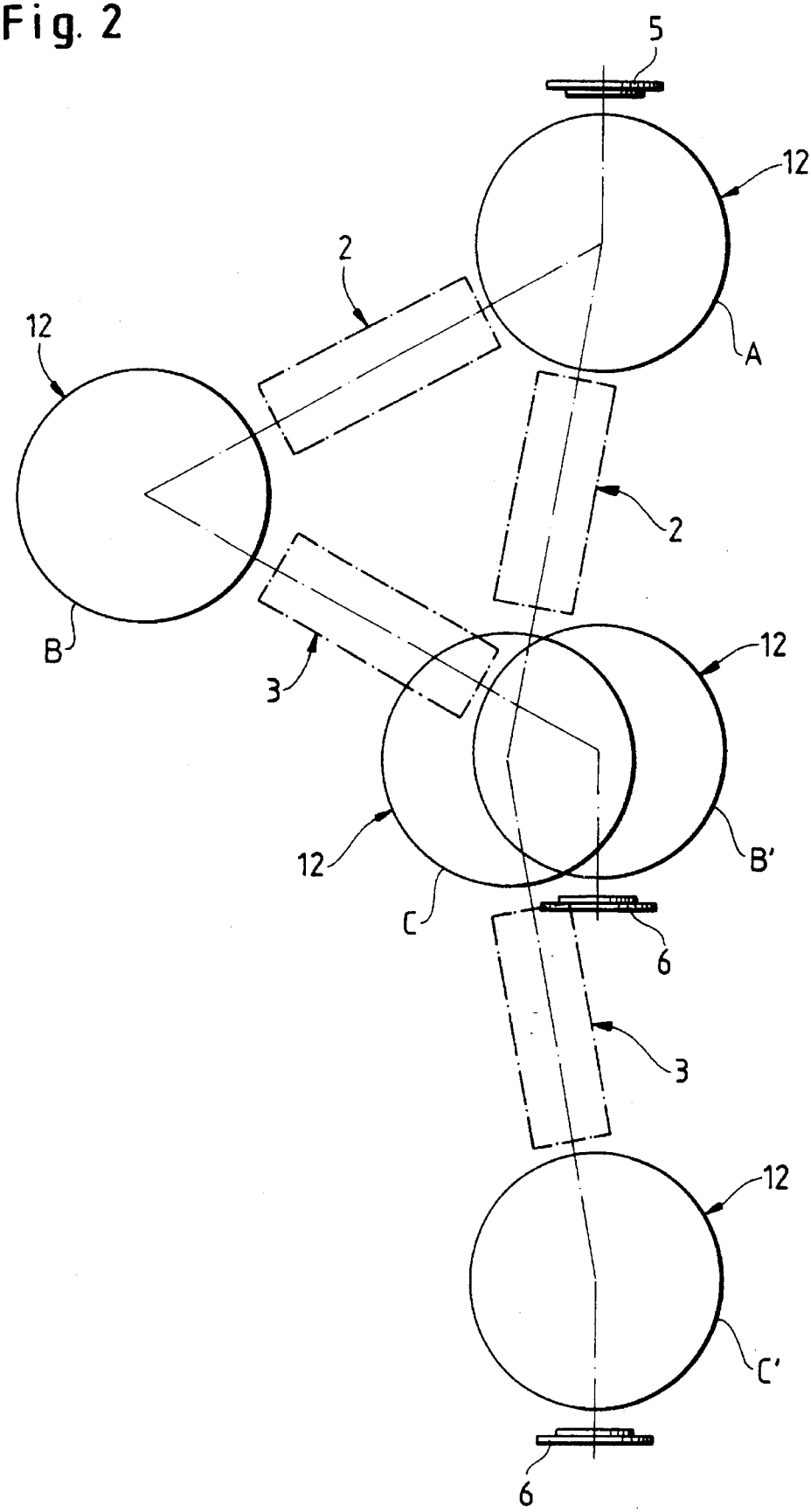
FIG. 2 is a diagrammatic representation of a side view of the pipeline shown in FIG. 1, also showing it in the shortened state.
Figure 3:
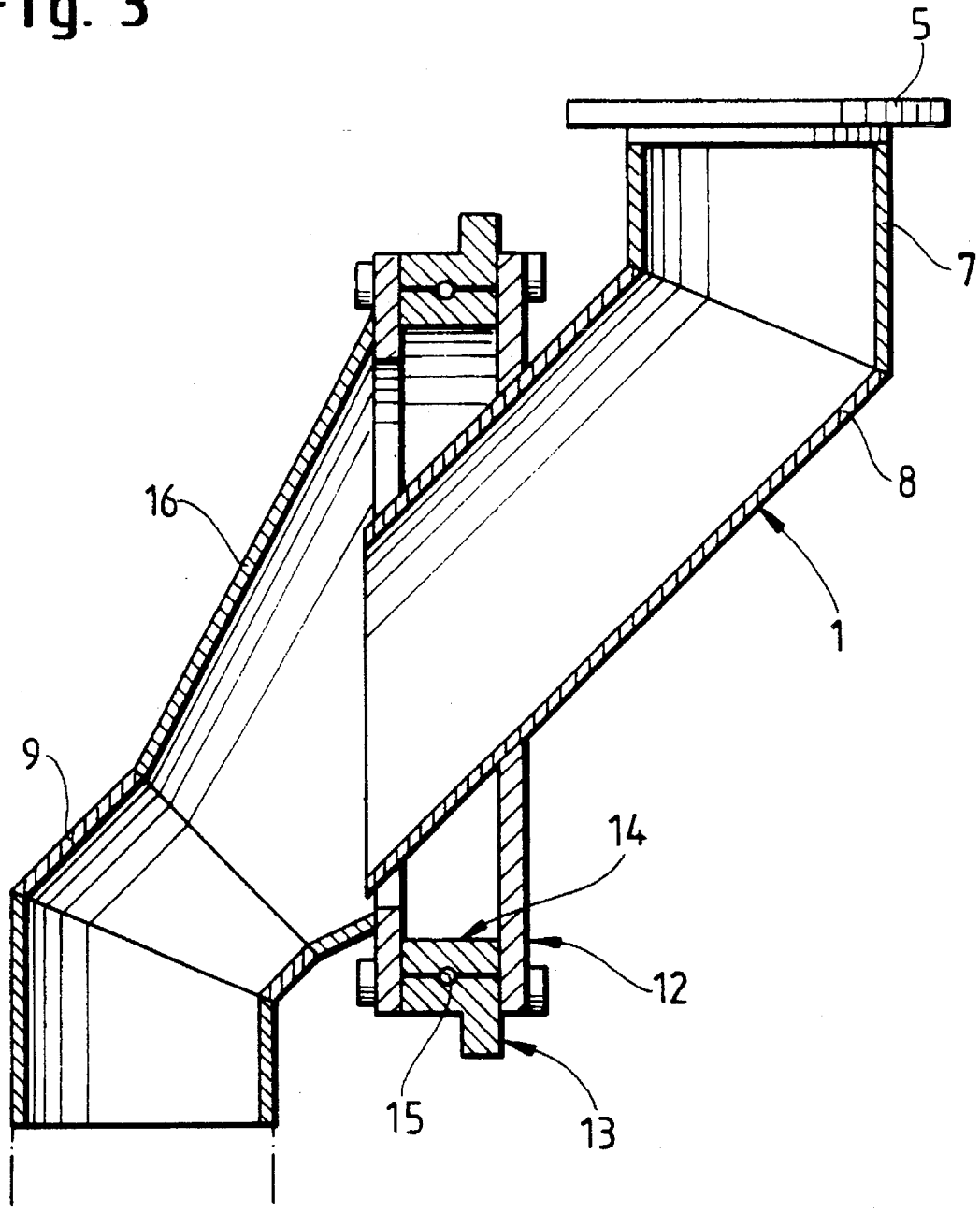
FIG. 3 shows on a larger scale two adjoining pipe sections with their rotary connection.

A substantially greater shortening results in the case of pivoting of the movable pipe elements 2 and 3 about the axes of the three rotary connections 12 like an articulated lever, as shown in FIG. 2.

What is claimed is:

1. A pipeline for conveying solids along a generally vertical conveying path from a first location to a treatment vessel disposed below said first location, said pipeline comprising:

a plurality of pipe elements, each of said pipe elements having first and second ends and comprising at least two pipe sections fixedly connected to each other such that the longitudinal axes of said connected pipe sections form an obtuse angle;

each of said pipe elements being connected at one end thereof to an end of another of said pipe elements;

at least two rotary connectors connecting said connected ends of said pipe elements together, said rotary connectors being vertically arranged along said vertical connecting path to thereby allow relative rotation between said connected ends of said pipe elements about a horizontal axis whereby the vertical length of the conveying path defined by said connected pipe elements can be shortened from a stretched state extending between said first location to said treatment vessel and a shortened state, by rotation of at least one of said pipe elements about the horizontal axis of rotation of a rotary connector connecting said pipe element to another of said pipe elements.

2. A pipeline according to claim 1 wherein at least one end of at least one of said pipe elements extends into at least one of said rotary connectors.

3. A pipeline according to claims 2 wherein at least one end of one of said pipe elements extends into one end of a connected pipe element.

4. A pipeline according to claim 3 wherein at least one end of one of said pipe elements is widened into a general funnel shape and is positioned at a location adjacent one of said rotary connectors.

5. A pipeline according to claim 1 wherein the respective pipe sections of the pipe elements connected by said rotary connectors lie on a common axis when said pipeline is disposed in the stretched state.

6. A pipeline according to claim 5 wherein, when said pipeline is disposed in the stretched state, the common axes of the pipe sections connected by said rotary connectors form an angle of about 30° with respect to the vertical.

* * * * *

UNITED STATES PATENT AND TRADEMARK OFFICE
CERTIFICATE OF CORRECTION

PATENT NO. : 5,566,989
DATED : October 22, 1996
INVENTOR(S) : Böing et al.

It is certified that error appears in the above-identified patent and that said Letters Patent is hereby corrected as shown below:

On title page, item

[30] Foreign Application Priority Data, "May 24" should be --May 25--.

[56] References Cited

Col. 2, "1/1932" should be --5/1932--.
Col. 2, "Klinger" should be --Klingler--.
Col. 2, Add -- FOREIGN PATENT DOCUMENTS
2547686 12/1976 Germany
2360066 5/1975 Germany --

Col. 1, line 36, after "from" omit "a".
Col. 1, line 45, after "concerned" insert a dash (-).
Col. 2, line 14, "Of" should be --of--
Col. 2, line 20, "Clear" should be --clear--
Col. 2, line 44, after "one" omit the comma (,).

UNITED STATES PATENT AND TRADEMARK OFFICE

CERTIFICATE OF CORRECTION

PATENT NO. : 5,566,989

DATED : October 22, 1996

INVENTOR(S) : Böing et al.

It is certified that error appears in the above-identified patent and that said Letters Patent is hereby corrected as shown below:

Col. 3, line 2, in the sub-heading, "DRAWINGS" should be --INVENTION--.

Col. 3, line 38, "Vacuum" should be --vacuum--

Col. 4, line 28 "claims" should be --claim--.

Signed and Sealed this

Twenty-fifth Day of March, 1997

*Attest:*

*Attesting Officer*

Bruce Lehman

BRUCE LEHMAN

*Commissioner of Patents and Trademarks*